United States Patent [19]

Poyer

[11] Patent Number: 4,564,890

[45] Date of Patent: Jan. 14, 1986

[54] OUTDOOR LIGHTING FIXTURE USING U-SHAPED FLUORESCENT LAMP

[76] Inventor: David D. Poyer, 858 Roseway St., Naples, Fla. 33942

[21] Appl. No.: 679,551

[22] Filed: Dec. 7, 1984

[51] Int. Cl.[4] ..... F21S 5/00

[52] U.S. Cl. ..... 362/216; 362/260; 362/311; 362/363; 362/431

[58] Field of Search ..... 362/216, 260, 267, 310, 362/311, 351, 353, 361, 362, 363, 375, 431

[56] References Cited

U.S. PATENT DOCUMENTS

| | | | |
|---|---|---|---|
| 2,905,863 | 9/1959 | Martin et al. | 362/216 X |
| 3,974,584 | 8/1976 | Shorette | 362/216 X |
| 4,142,179 | 2/1979 | Lowndes | 362/363 X |
| 4,215,390 | 7/1980 | Brandt | 362/311 |
| 4,447,864 | 5/1984 | Smith et al. | 362/361 X |
| 4,499,527 | 2/1985 | Tauber et al. | 362/311 X |
| 4,503,563 | 3/1985 | Johnson | 362/267 X |

*Primary Examiner*—Tony M. Argenbright

*Assistant Examiner*—W. R. Wolfe

*Attorney, Agent, or Firm*—Merrill N. Johnson

[57] ABSTRACT

A fluorescent lighting fixture designed for outdoor use and constructed mainly of polyvinyl chloride. The fixture includes a cylindrical housing made entirely of white high density polyvinyl chloride with an annular ring projecting from its inner wall, a U-shaped standard voltage fluorescent lamp, a socket for said lamp, a circular base supporting said socket and resting on the ring of the cylindrical housing, a retaining ring resting on the upper edge of the circular base, a closed-ended tubular transparent diffuser resting on the upper edge of said retaining ring, a pair of flexible O-rings encircling the lower open end of said diffusor for securing the diffuser within the housing, a circular rear bushing, and a power line passing through a hole in the base plate for energizing said lamp. The U-shaped fluorescent lamp is sealed within the housing by the two O-rings and the closed-ended tubular diffuser.

4 Claims, 3 Drawing Figures

OUTDOOR LIGHTING FIXTURE USING U-SHAPED FLUORESCENT LAMP

BACKGROUND AND SUMMARY OF THE INVENTION

My invention relates to an electric lighting fixture and in particular to a fluorescent fixture using a standard voltage U-shaped fluorescent lamp designed for outdoor use and constructed mainly of polyvinyl chloride resin.

Up to now, for various reasons, almost all electric lighting fixture housings and fittings have been made of metal. One reason is that metals do not deteriorate or deform as the result of the high temperatures generated within a lighting fixture by incandescent 110 volt lamps used in conventional lighting fixtures. However, for lighting fixtures designed for use out-of-doors, most metal housings and fittings are subject to rapid corrosion due to constant exposure to rain and sun and, in coastal areas, to salt spray, even when the metal parts are temporarily protected by paint. Moreover, recent increases in the price of metals and in fabricating costs have resulted in increases in the prices of conventional lighting fixtures with housings and fittings made of metal.

The present trend to reduce energy consumption has resulted in increased use of low voltage lamps, that is, incandescent lamps which operate at voltages considerably less than 110 volts. These low voltage lamps, particularly 12 volt incandescent lamps, generate far less heat in operation than 110 volt lamps.

My prior patent application Ser. No. 623,319 filed June 22, 1984, pointed out that it was possible to construct a very satisfactory outdoor lighting fixture for use with a low voltage incandescent lamp which has a housing and essentially all its components made of polyvinyl chloride resin. Such a lighting fixture is less expensive to manufacture and more durable than conventional outdoor fixtures using incandescent lamps.

I have now developed a unique outdoor lighting fixture using a standard voltage U-shaped fluorescent lamp. This novel fixture includes ten major components as follows: a cylindrical housing having at its center an interior annular ring preferably made entirely of white high density polyvinyl chloride resin (hereinafter often referred to as PVC); a U-shaped fluorescent lamp; a socket for said lamp; a circular base supporting said socket having an outer diameter slightly less than the inside diameter of the cylindrical housing; a 120 volt transformer mounted on the base; a retaining ring having an outer diameter slightly less than the inside diameter of the housing; a closed-ended tubular transparent diffuser having a diameter somewhat less than the inner diameter of the housing; a pair of flexible O-rings for securing the diffuser to the housing; and a circular bushing preferably made of PVC for sealing the rear of the housing and containing an annular opening for the electric wires connected to energize the U-shaped fluorescent lamp.

As assembled, the base supporting the lamp, socket and transformer is seated on the upper edge of the interior ring of the cylindrical housing. Then the retaining ring is seated on the upper edge of the base. Next the two O-rings are slipped over the open end of the tubular diffuser. Then the open end of the diffuser is firmly pressed into the upper end of the cylindrical housing and secured within the housing by the two compressed O-rings. The electric wires connected to energize the lamp are contained within a tubular conduit which enters the fixture through the annular opening in the circular bushing that seals the rear of the housing.

As mentioned in my aforesaid prior application, there are a number of prior suggestions in the art to use various plastic and elastomeric resins in the fabrication of lighting fixture components. These suggestions include U.S. Pat. Nos. 3,902,057; 4,210,841; 4,360,862; 4,379,321; 4,380,793 and 4,414,613. However, my outdoor lighting fixture using a standard voltage U-shaped fluorescent lamp possesses the following advantages over conventional outdoor fixtures:

1. Because most of its components are already available in quantity, the cost of its components is lower than the cost of conventional fixture components.

2. Because its components can be quickly assembled by unskilled labor, my lighting fixture costs less to manufacture than conventional fixtures.

3. Because it utilizes a standard voltage fluorescent lamp which generates very little heat and its housing is constructed of white high density polyvinyl chloride resin, the housing will not deteriorate or deform in operation.

4. Because its housing and most of the fittings are made of white high density polyvinyl chloride resin, the fixture is literally impervious to the deleterious effects of sun, rain and salt spray even in tropical climates.

DETAILED DESCRIPTION OF THE PREFERRED EMBODIMENT

Figure 1:
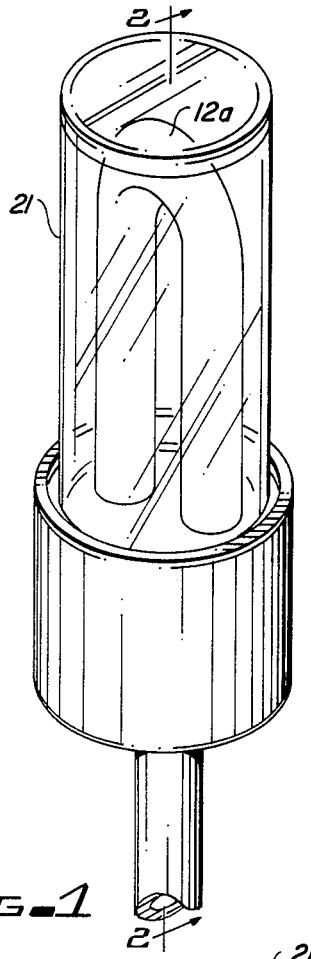
FIG. 1 is a perspective view of a preferred embodiment of my outdoor lighting fixture.
Figure 2:
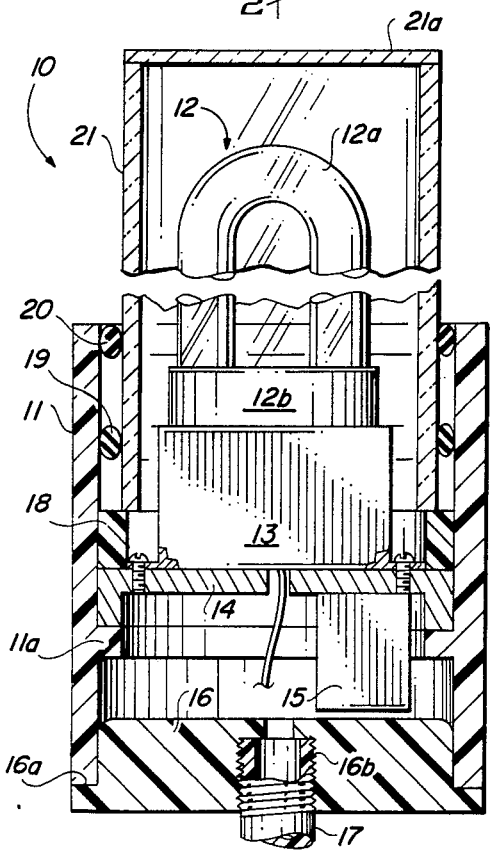
FIG. 2 is a cross-sectional side view partially broken away of my lighting fixture shown in FIG. 1 taken along line 2—2 which shows the details of the various components of the fixture and the manner of their assembly.
Figure 2:
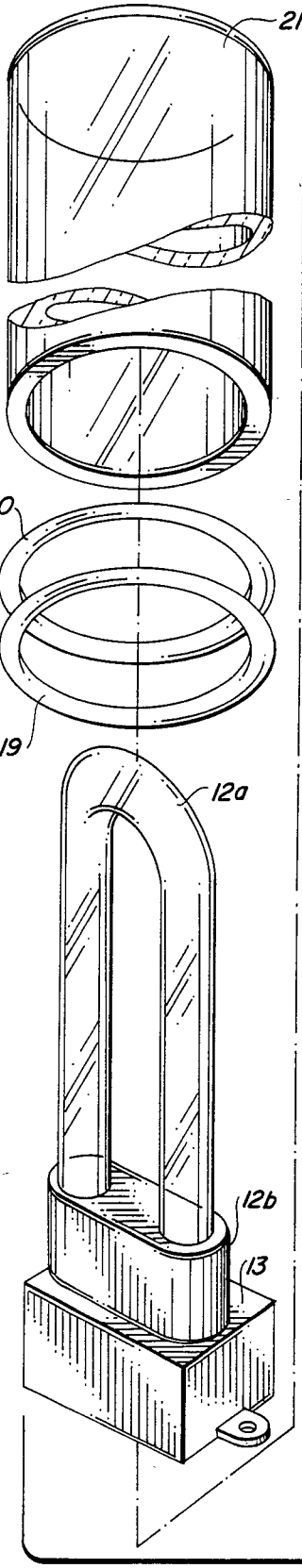

Referring to the drawings which illustrate a preferred embodiment of my outdoor lighting fixture but which are not intended to limit the scope of the invention, FIG. 1 is a perspective view and FIG. 2 is cross-sectional side view of my outdoor lighting fixture 10 with its cylindrical housing 11 and tubular diffuser 21 in a vertical position supported by tubular conduit 17. Conduit 17 contains the 110 volt electric power line which energizes a U-shaped fluorescent lamp 12 within housing 11 and diffuser 21.

Figure 3:
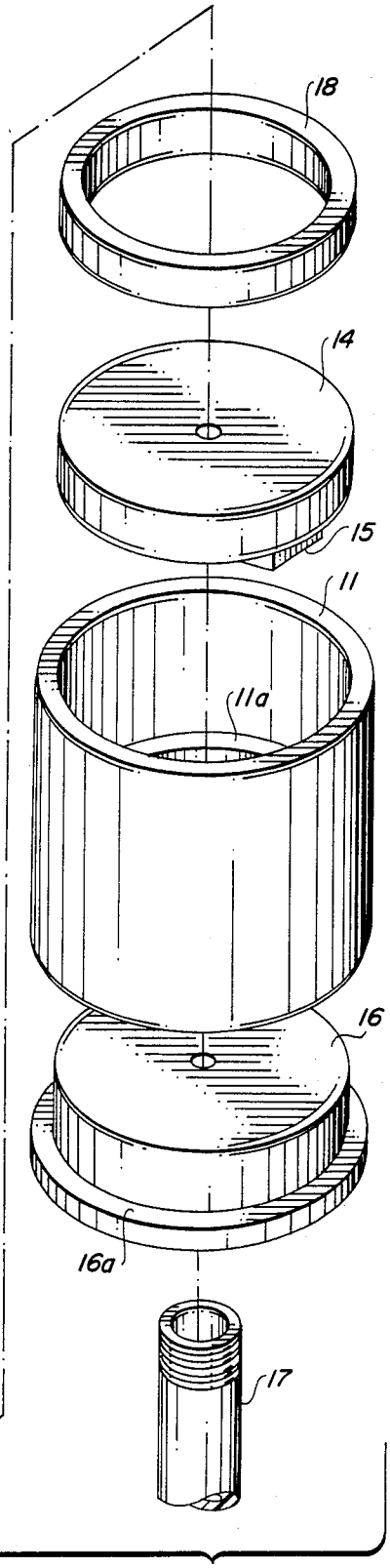
FIG. 3 is an exploded perspective view of the lighting fixture which is shown in FIGS. 1 and 2.

FIGS. 2 and 3 show in detail the major components of my lighting fixture. Housing 11 is a standard two and one-half inch diameter coupling conventionally used for joining electrical plastic conduit (EPC) measuring approximately four inches end to end and with an annular ring 11*a* molded into the interior surface of housing 11. Ring 11*a* is preferably square in cross-section. Most couplings used to join electrical plastic conduit are made of the same white high density polyvinyl chloride resin as the conduit itself. Preferably the housing of my fixture is manufactured to meet National Electrical Manufacturers Association standards designation EPC-40-PVC or EPC-80-PVC.

A fluorescent lamp assembly sits on the upper edge of ring 11*a*. The lamp assembly consists of a U-shaped fluorescent lamp 12, a socket 13, a 120 volt transformer 15, and a generally cylindrical base 14.

Fluorescent lamp 12 is preferably a seven watt input, 40 watt output Osram DuLux lamp with a U-shaped tube 12*a* and a bayonet-type base 12*b*. However, other U-shaped lamps having a varying output may be used. Lamp 12 has an overall height of 5¼ inches and its base 12*b* plugs into socket 13 which is mounted on the upper face of metal base 14 as shown in FIG. 2.

Base 14 has a cylindrical outer face having a diameter slightly less than the inner diameter of housing 11 so that base 14 rests on the inner annular ring 11*a* of the housing. In addition to lamp 12 and socket 13, base 14 supports a 120 volt transformer 15 prewired for 6, 7, 8 and 9 watt delivery to socket 13 and lamp 12. Preferably lamp 12, socket 13, base 14 and transformer 15 comprise an assembly which can be easily inserted into housing 11 with the outside lower edge of the cylindrical base 14 resting on the upper face of housing ring 11*a*.

The lower end of housing 11 is sealed by a flanged circular bushing 16 made of PVC as are housing 11 and retaining ring 18. Bushing 16 includes a flange 16*a* sized to fit bushing 16 over the lower end of housing 11 and these two components are securely bonded together by a suitable water-impervious adhesive.

Bushing 16 contains a threaded circular hole 16*b* in its center into which is screwed a tubular conduit 17 containing the 110 volt power line which is connected to transformer 15. Conduit 17 may be made of either metal or a suitable plastic such as PVC or polyethylene. The end of conduit 17 is preferably threaded and thus secured to the bushing 16 as shown in FIG. 2.

With the 110 volt power line wired to the lamp assembly and the assembly's base 14 resting securely on housing ring 11*a* as shown in FIG. 2, an annular retaining ring 18 of PVC having an outer diameter slightly less than the inner diameter of housing 11 is inserted over lamp 12 to rest on the upper face of cylindrical base 14. The lamp assembly is now sealed for protection against water, moisture and foreign objects by a plurality of flexible O-rings and a preferably cylindrical or tubular transparent diffuser.

In the preferred embodiment shown in FIG. 2, diffuser 21 is made of a clear plastic and in the form of a cylindrical tube having an outer diameter somewhat less than the inner diameter of housing 11 and a closed upper end 21*a*. Two similar flexible rubber O-rings 19 and 20 are placed around the lower open end of diffuser 21 and then the diffuser is firmly pressed down into the upper end of housing 11 until the lower end of the diffuser rests on the upper face of retaining ring 18. The two O-rings 19 and 20 will be compressed against housing 11 and diffuser 21 to act as a moisture-proof seal for the lamp assembly of fixture 10.

While fluorescent lamp 12 is thus quite securely sealed within fixture 10, the housing, retaining ring and bushing being made of white high density polyvinyl chloride will not deteriorate or deform as the result of constant year round exposure to rain, tropical sun and salt spray. It is important, however, that the components be made of white PVC since that color offers greater resistance to the collection of heat from the sun's rays or the operation of the lamp itself.

It will be apparent to those skilled in the art that various modifications of my lighting fixture may be made to increase the use of the fixture. For example, a globular or other form of light diffuser may replace the tubular diffuser. And a fixed or swivelled stand or mounting bracket could be attached at the rear of fixture 10 and other means than conduit 17 used to bring the power line into the interior of fixture 10. These and other modifications may be made without sacrificing the many advantages of my basic fixture as described above and as set forth in the following claims.

I claim:

1. A fluorescent lighting fixture for outdoor use comprising:

a cylindrical housing made entirely of polyvinyl chloride and having an upper end, a lower end and generally concentric inner and outer walls, said housing having an annular ring projecting from its inner wall, a fluorescent lamp assembly consisting of a U-shaped fluorescent lamp, a socket for said lamp, a circular base supporting said socket having upper and lower edges and having an outer diameter slightly less than the diameter of the inner wall of said housing, and a 120 volt transformer mounted on said base, the lower edge of said assembly's base being mounted on the annular ring of said housing, a bushing made entirely of polyvinyl chloride affixed to the lower end of said housing and having an axial hole through said housing, a retaining ring having an upper face and a lower face with an outer diameter slightly less than the diameter of the inner wall of said housing mounted within said housing and resting on the upper edge of the assembly's base.

a closed-ended tubular transparent diffuser having a diameter somewhat less than the diameter of the inner wall of said housing resting on the upper face of said retaining ring, and a pair of flexible O-rings each having an outer diameter slightly larger than the diameter of the inner wall of the housing and an inner diameter slightly less than the diameter of the outerface of said tubular diffuser, each of said O-rings encircling said tubular diffuser and located within said housing for removably securing said diffuser to said housing.

2. A lighting fixture as set forth in claim 1 in which the cylindrical housing, the bushing and the retaining ring are all made of white high density polyvinyl chloride resin.

3. An electric lighting fixture for outdoor use comprising:

a cylindrical housing made of polyvinyl chloride and having an upper end, a lower end and generally concentric inner and outer walls, said housing having an annular ring projecting from its inner wall, a fluorscent lamp assembly consisting of a low voltage lamp, a socket for said lamp, and circular base supporting said socket having upper and lower edges and having an outer diameter slightly less than the diameter of the inner wall of said housing, the lower edge of said assembly's base being mounted on the annular ring of said housing, a bushing made of polyvinyl chloride affixed to the lower end of said housing and having a hole through said housing, a retaining ring having an upper face and a lower face with an outer diameter slightly less than the diameter of the inner wall of said housing mounted within said housing and resting on the upper edge of the assembly's base, a closed-ended transparent diffuser having an open end with a diameter somewhat less than the diameter of the inner wall of said housing resting on the upper face of said retaining ring, and a flexible O-ring having an outer diameter slightly larger than the diameter of the inner wall of the housing and an inner diameter slightly less than the diameter of the outer face of said tubular diffuser, said O-ring encircling said tubular diffuser and located within said housing for removably securing said diffuser to said housing.

4. An electric lighting fixture as set forth in claim 3 in which the cylindrical housing, the bushing and the retaining ring are all made entirely of white high density polyvinyl chloride resin.

* * * * *